US006939255B2

(12) United States Patent
Peterson

(10) Patent No.: US 6,939,255 B2
(45) Date of Patent: Sep. 6, 2005

(54) COLLAPSIBLE BATTING CAGE

(76) Inventor: Kennith L. Peterson, 4168 Rainwood Ave., Yorba Linda, CA (US) 92886

( * ) Notice: Subject to any disclaimer, the term of this patent is extended or adjusted under 35 U.S.C. 154(b) by 0 days.

(21) Appl. No.: 10/623,349

(22) Filed: Jul. 21, 2003

(65) Prior Publication Data

US 2005/0020389 A1 Jan. 27, 2005

(51) Int. Cl.[7] ..... A63B 67/00; E04B 1/12; E04H 15/32

(52) U.S. Cl. ..... 473/415; 135/913; 52/63

(58) Field of Search ..... 135/913, 143–145, 135/125, 117, 133, 128, 136, 151, 153, 148, 121; 52/63, 64, 70, 71; 473/421, 422, 490, 197, 468; 273/410

(56) References Cited

U.S. PATENT DOCUMENTS 2,055,044 A * 9/1936 Nelson ..... 135/125
2,823,034 A 2/1958 Bingham, Jr.
2,923,547 A 2/1960 Heeremans
3,222,067 A * 12/1965 Litwhiler et al. ..... 473/421
3,540,458 A * 11/1970 Featheringill et al. ..... 135/133
3,593,997 A * 7/1971 Boehner ..... 473/421
4,066,089 A * 1/1978 Rainwater ..... 135/151
4,192,503 A * 3/1980 Karas ..... 473/459
4,211,413 A * 7/1980 Arzola ..... 473/468
4,257,199 A * 3/1981 Kuboyama ..... 52/2.17
4,262,460 A * 4/1981 Bertin ..... 52/64
4,280,306 A * 7/1981 Milinic ..... 52/63
RE31,565 E * 4/1984 Beaulieu ..... 135/145
4,716,919 A * 1/1988 Griffin ..... 135/133
4,733,865 A 3/1988 Reed
4,815,736 A 3/1989 Wright
4,844,109 A * 7/1989 Navarro ..... 135/129
4,890,834 A 1/1990 Ponza
4,947,884 A * 8/1990 Lynch ..... 135/97
5,178,384 A * 1/1993 Gorman ..... 473/451
5,205,564 A * 4/1993 Lamberti et al. ..... 273/400
5,452,896 A * 9/1995 Core ..... 473/164
5,460,363 A * 10/1995 Tomer ..... 473/454
5,577,721 A * 11/1996 Hardee et al. ..... 473/421
5,672,125 A * 9/1997 Ross ..... 473/421
5,797,411 A * 8/1998 Parker ..... 135/136
5,820,494 A * 10/1998 Gates et al. ..... 473/421
6,070,604 A * 6/2000 Carter ..... 135/145
6,206,020 B1 * 3/2001 Lynch ..... 135/128
6,412,507 B1 * 7/2002 Carter ..... 135/145
6,550,491 B1 * 4/2003 Bixler et al. ..... 135/145
6,666,223 B2 * 12/2003 Price et al. ..... 135/131
6,698,440 B2 * 3/2004 Beyer et al. ..... 135/25.41
6,725,873 B2 * 4/2004 Liu ..... 135/145
6,748,962 B2 * 6/2004 Miller ..... 135/130
6,766,623 B1 * 7/2004 Kalnay ..... 52/641

* cited by examiner

*Primary Examiner*—Mitra Aryanpour
(74) *Attorney, Agent, or Firm*—Morland C. Fischer

(57) ABSTRACT

A collapsible batting cage having a support base (e.g., a front end, a back end and opposite sides) and a support frame to which a protective netting is attached. The support frame includes a plurality of U-shaped frame members that are pivotally connected to the support base so as to be rotatable relative thereto between a collapsed position, when the batting cage is not in use, to a raised position, when the batting cage is in use. A cable that is tied to the plurality of U-shaped frame members receives a pulling force from a winch for causing the U-shaped frame members to rotate from the collapsed position, where the protective netting is folded at an inconspicuous location within the support base, to the raised position, where the netting will hang above the support base. With the U-shaped frame members of the support frame rotated to the raised position and the netting hanging downwardly therefrom, the batting cage will provide a confined enclosure within which sports (e.g., baseball, golf, soccer, football, etc.) can be practiced without subjecting onlookers and property to the risk of injury or damage.

6 Claims, 4 Drawing Sheets

COLLAPSIBLE BATTING CAGE

BACKGROUND OF THE INVENTION

1. Field of the Invention

This invention relates to a collapsible batting cage that is adapted to be quickly and easily rotated between a collapsed, folded position when the batting cage is not in use and a raised, upstanding position ready for use. The batting cage provides a confined enclosure within which sports (e.g., baseball, golf, soccer, football, etc.) can be practiced without subjecting onlookers and property to the risk of injury or damage.

2. Background Art

Batting cages are available to the public at amusement parks and similar recreational facilities. However, it is an inconvenience for an athlete to have to frequently pack his gear and then travel to a distant site to improve his game. Moreover, public batting cages are not available to the athlete on a 24 hour basis. Similarly, the fees to use a public facility to practice one's games can become a cost problem, particularly when the athlete is young and must depend on his parents to cover his expenses.

For all of these reasons, it would be desirable for an athlete to have continuous access to his own personal batting cage so that practice sessions can be held at the convenience of the athlete. If the personal batting cage were located at home or a similar residential facility, the athlete would not have to travel to a remote location to hold practice. In this regard, a residential batting cage would be of particular advantage to ambitious youngsters who are too young to drive and who do not wish to inconvenience their parents.

However, any such personal batting cage that is located in a residential area must be able to be disposed at an out of sight location when not in use so as to avoid posing an eyesore to neighbors and the community at large. What is more, the batting cage must be capable of being installed in combination with a supporting structure (e.g., walls, fences, railing, and the like) which does not violate local ordinances.

SUMMARY OF THE INVENTION

In general terms, a collapsible batting cage is disclosed within which an athlete can practice pitching and batting a baseball without subjecting onlookers and property to the risk of injury or damage. The batting cage herein described in also suitable to enable other sports (e.g., golf, soccer, football, etc.) to be practiced within a safe environment for bystanders. The collapsible batting cage of this invention is particularly suitable for use in a residential area and includes a support frame that is adapted to be rotated between a collapsed position, when the batting cage is not in use, and a raised position, when the batting cage is to be used to practice one's game.

The support frame includes a plurality of (e.g., three) U-shaped frame members that are pivotally connected to a pair of side railings or a similar structure by means of hinge pins, whereby the support frame is rotatable relative to the side railings. The U-shaped frame members are linked together so as to be rotated in unison between the collapsed position so as to lie below the tops of the side railings and the raised position so as to stand upwardly above the side railings. The opposing pair of side railings cooperate with a front end railing and a back end railing to establish a confined practice area within which a baseball may be thrown and/or hit. A reversible winch is mounted on the front end railing, and a pull-up rail is slidable vertically along the back end railing.

A protective netting is tied to the U-shaped frame members of the support frame and to the pull-up rail so as to hang downwardly therefrom to cover the insides of the front end railing, the back end railing, and the opposing side railings. A cable which is connected to the winch at the front end railing is looped around the tops of each of the U-shaped frame members and then attached to the pull-up rail at the back end railing. When the reversible winch turns in a first direction, a pulling tension is generated in the cable to cause the support frame to be rotated to the raised position and the pull-up rail to slide upwardly, whereby the protective netting is correspondingly lifted above the front end, back end and side railings. However, when the winch turns in an opposite direction, the pulling tension in the cable is relaxed to allow the support frame to be rotated to the collapsed position and the pull-up rail to slide downwardly, whereby the netting is correspondingly lowered to a non-obtrusive, out of site location surrounded by the front end, back end, and side railings.

DETAILED DESCRIPTION

Figure 1:
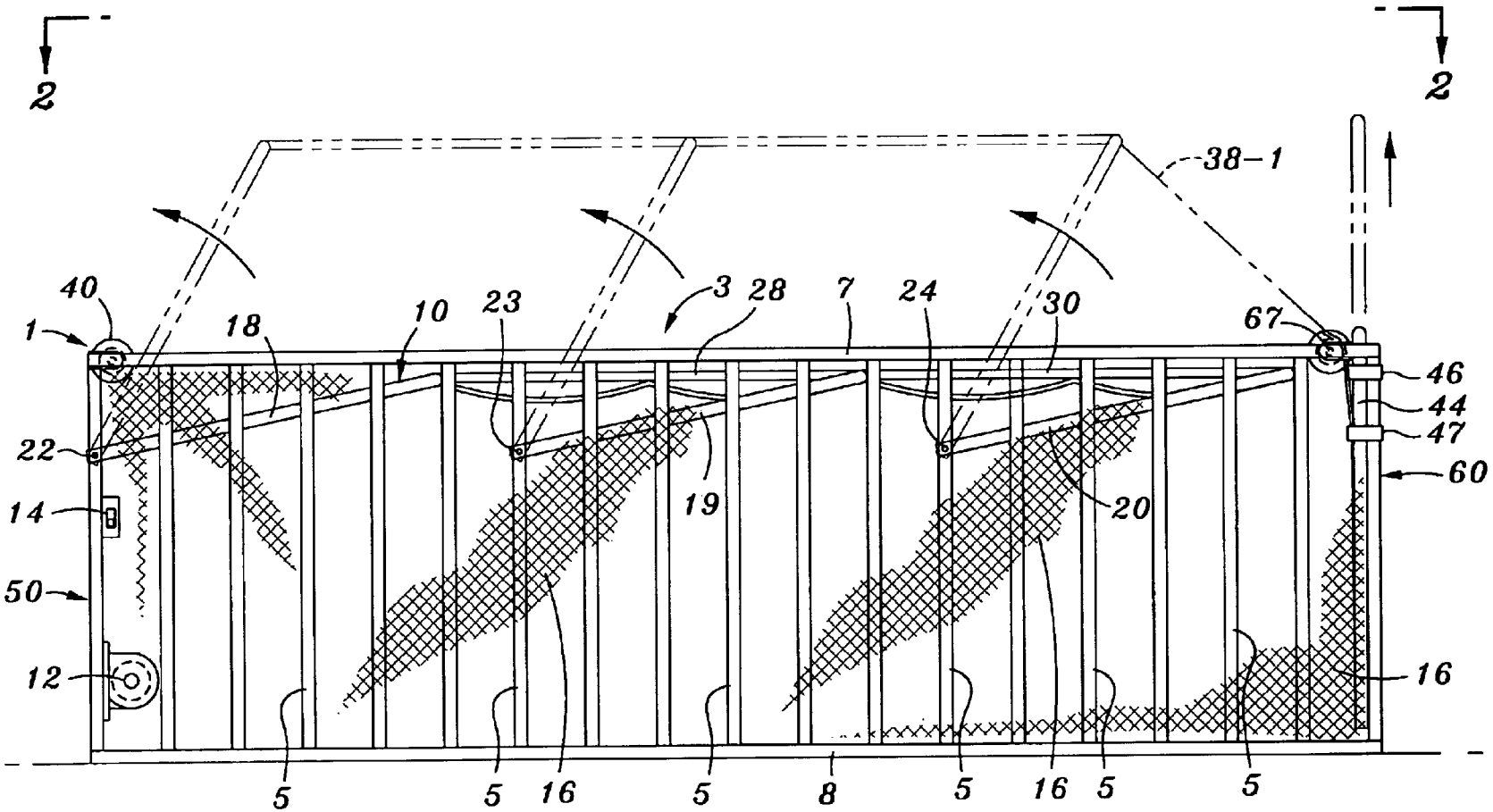
FIG. 1 is a side view of the collapsible batting cage of this invention in a collapsed position during non-use.
Figure 2:
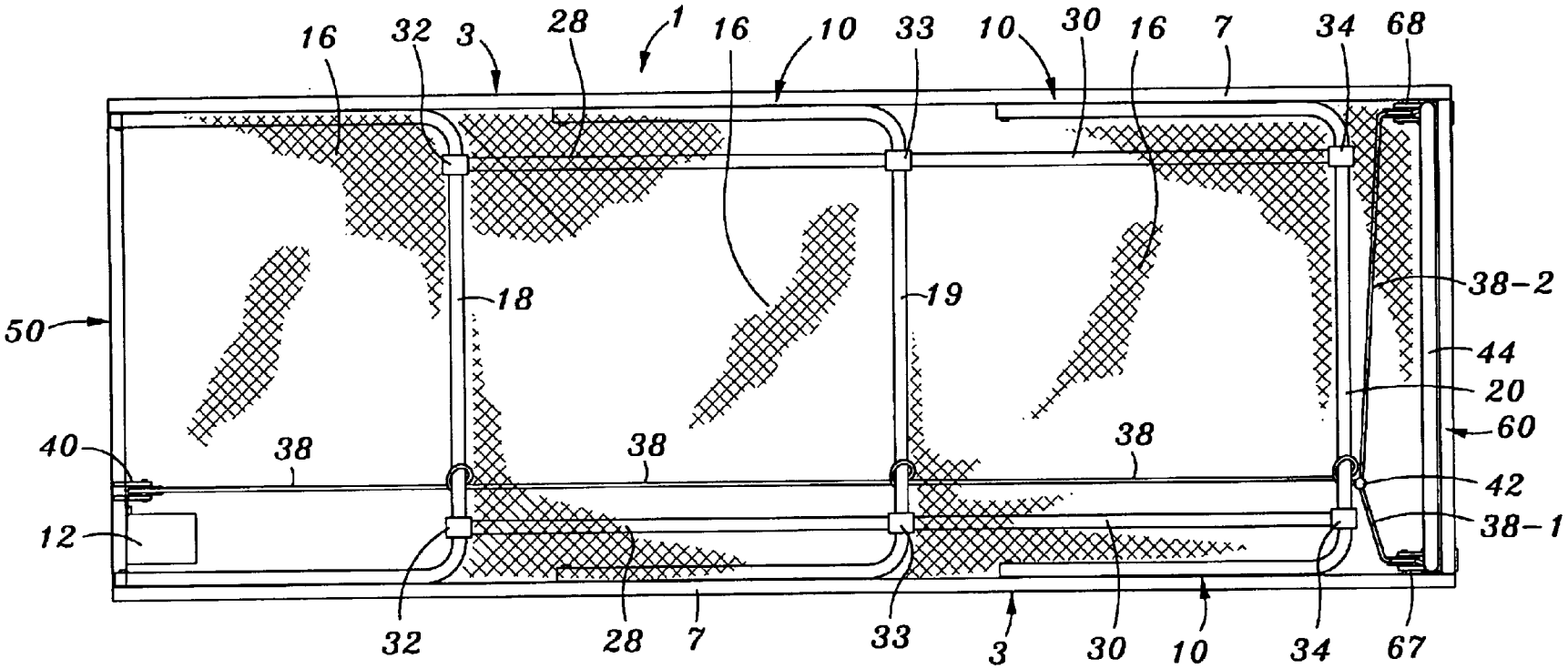
FIG. 2 is a top view of the collapsible batting cage in the collapsed position taken along lines 2—2 of FIG. 1.
Figure 3:
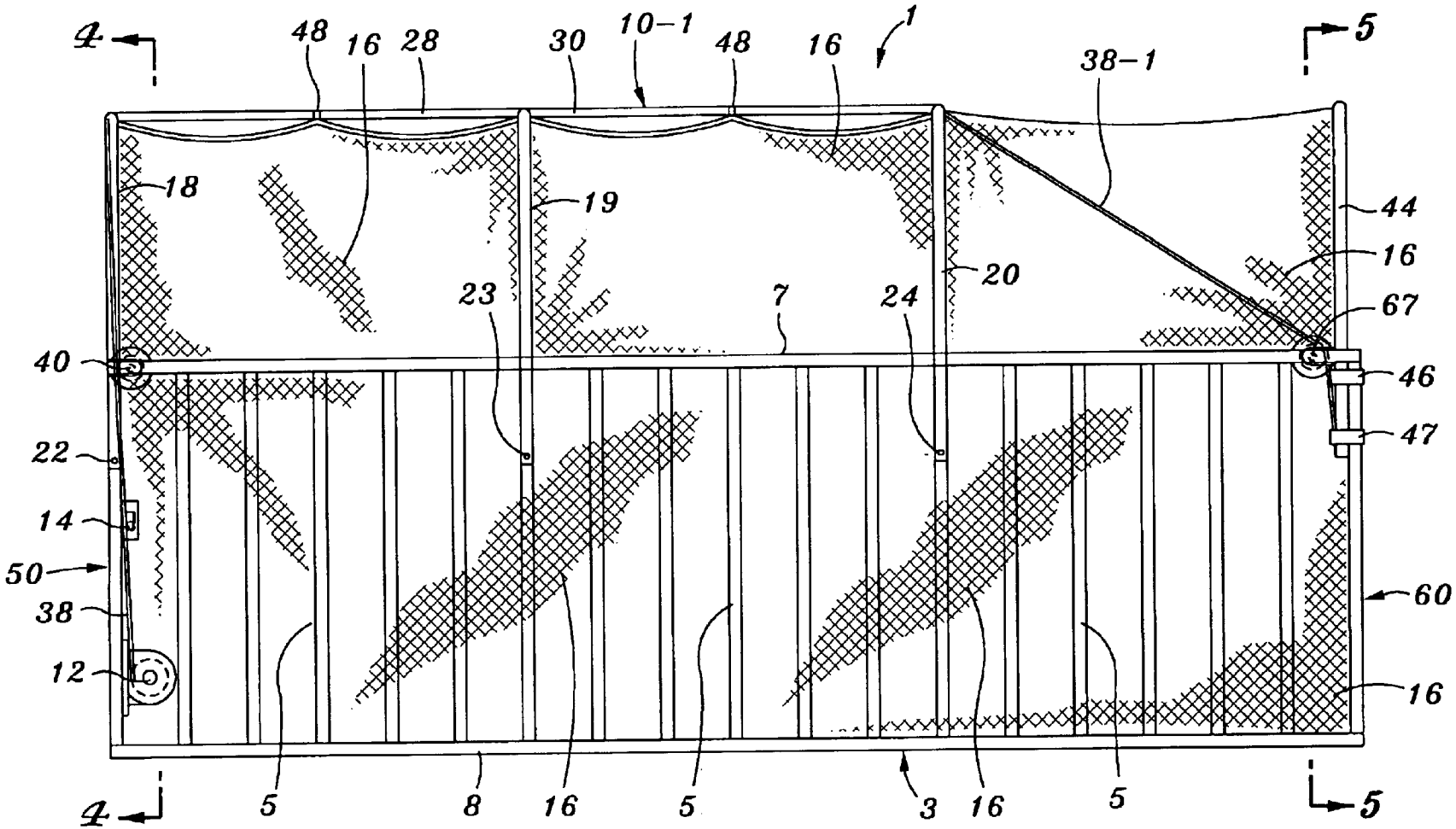
FIG. 3 is a side view of the collapsible batting cage in a raised position ready for use.

The collapsible batting cage 1 which forms the present invention is initially described while referring concurrently to FIGS. 1–3 of the drawings, where there is shown the batting cage 1 coupled to a pair of metal side railings 3 (best shown in FIG. 2) that are separated from one another to define the width of the practice area. Each side railing 3 has a series of spaced, parallel aligned rails 5 extending vertically between upper and lower support rails 7 and 8. However, it is to be understood that the collapsible batting cage 1 can also be used in conjunction with a pair of walls, fences, or similar structures, having a height of typically six feet or less so as to be able to comply with local ordinances in certain communities.

The collapsible batting cage 1 includes a support frame 10 that is pivotally coupled to the inside of the pair of side railings 3 and adapted to be rotated between a collapsed position (as shown in FIG. 1) at which time the batting cage is not in use to a raised position (as shown in FIG. 3) at which time the batting cage is ready for use. As will be described in greater detail hereinafter, the support frame 10 is moved between the collapsed and raised positions by means of a conventional reversible winch 12 (e.g. having a lift capacity of approximately 800 pounds). A control switch 14 is provided to selectively control the operation and direction of the winch 12 and the corresponding position of the batting cage 1 relative to the side railings 3.

The collapsible batting cage 1 also includes a suitable netting 16 that is tied to and carried by the support frame 10 so as to be pulled or pushed by the support frame between the collapsed and raised positions. By way of example only, the netting 16 is a commercially available, sun resistant netting that is manufactured from polyethylene and formed with a plurality of 3.5 by 3.5 cm square sections that are sized to trap a baseball that is hit or thrown within the batting cage 1. In the ready to use, raised position of the support frame 10, the netting 16 will completely cover the interior of side railings 3 so as to prevent a thrown or struck baseball from causing injury or damage to an observer or property located outside the batting cage.

As is best shown in FIGS. 2 and 3, the pivotal support frame 10 which carries the netting 16 includes a plurality of U-shaped frame members 18, 19 and 20. In the present example, the support frame 10 includes a total of three U-shaped frame members 18–20 that are evenly spaced about 15–20 feet apart to simulate the distance between a pitching mound and the batter's box within which the hitter is located. However, the precise number of frame members and the distance therebetween is a matter of convenience depending upon the overall length and use of the batting cage 1.

The legs of the U-shaped frame members 18–20 are pivotally connected to respective ones of the rails 5 of each of the pair of side railings 3 by means of hinge pins 22, 23 and 24, or the like. Thus, the frame members 18–20 can rotate around their hinge pins 22–24 through an arc of approximately 90 degrees. That is, with the support frame 10 in the collapsed position of FIG. 2, the U-shaped frame members 18–20 will lie flat and generally end-to-end one another below the upper support rails 7 of side railings 3. When the support frame 10 is rotated to the raised position of FIG. 3, the U-shaped frame members 18–20 will stand upwardly and in parallel alignment with one another so as to extend above the upper support rails 7 of side railings 3.

To ensure that the U-shaped frame members 18–20 travel together to achieve a smooth transition of the support frame between the collapsed position (designated 10 in FIGS. 1 and 2) and the raised position (designated 10-1 in FIG. 3), pairs of tubular coupling bars 28 and 30 are interconnected between the frame members 18–20 at hollow eye sockets 32, 33 and 34 that surround the top of each U-shaped frame member. More particularly, a first pair of coupling bars 28 extends from a respective pair of sockets 32 that surround the top of the first U-shaped member 18 to a respective pair of sockets 33 that surround the top of the second U-shaped frame member 19. A second pair of coupling bars 30 extends from the sockets 33 at the top of the second U-shaped frame member 19 to a respective pair of sockets 34 that surround the top of the third U-shaped frame member 20. By virtue of the pairs of coupling bars 28 and 30, when one of the U-shaped frame members 18–20 of support frame 10 is raised or lowered, all of frame members will be simultaneously raised or lowered.

As was earlier disclosed, the support frame 10 is moved between the collapsed and the raised positions by means of a reversible winch 12. The winch 12 is preferably mounted adjacent the control switch 14 on a front end railing 50. As is best shown in FIG. 3, cable 38 runs upwardly and continuously from the winch 12 for attachment to the support frame 10 by way of a guide roller or pulley 40. The guide roller 40 may be mounted at the top of the front end railing 50 so as to lie above the winch 12.

Figure 4:
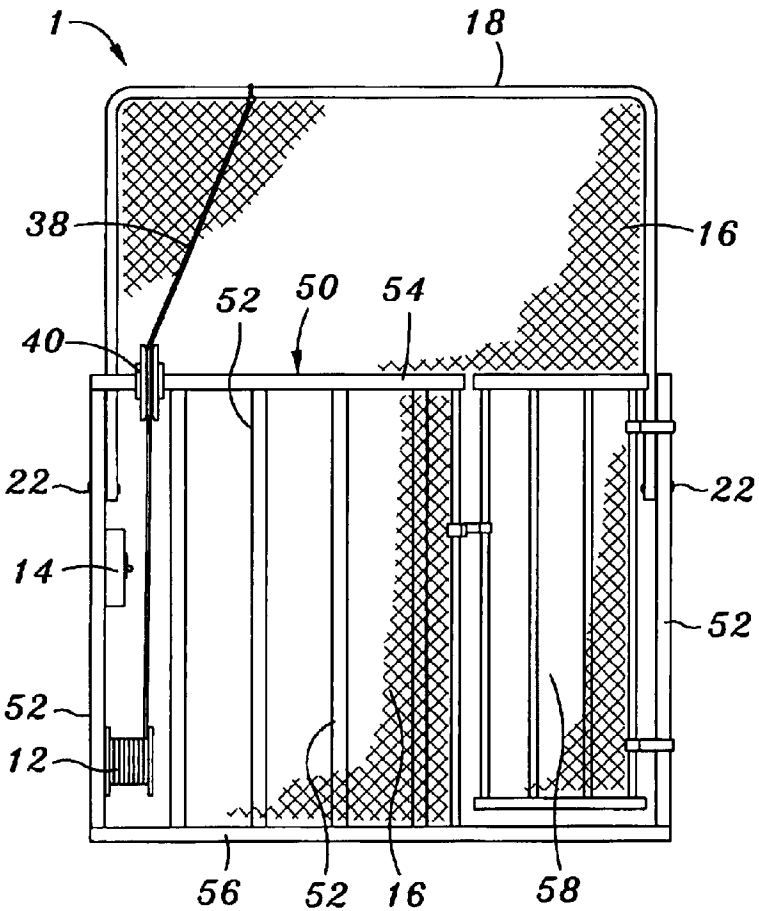
FIG. 4 shows a front end railing taken along lines 4—4 of FIG. 3.

Turning briefly to FIG. 4 of the drawings, the front end railing 50 is shown at the front of the batting cage 1 to which the reversible winch 12 and the guide roller 40 are affixed. The front end railing 50 extends between the opposing pair of side railings 3. Like side railings 3, the front end railing 50 includes a plurality of spaced, parallel aligned rails 52 that run between upper and lower support rails 54 and 56. A rotatable entry gate 58 is located within the front end railing 50 to allow access to the interior of batting cage 1.

As is best shown in FIG. 2, the cable is then tied (e.g. looped around) the tops of each of the U-shaped frame members 18–20 of support frame 10. Accordingly, when the winch 12 turns in a first direction, a tension is created within the cable 38 and a corresponding pulling-force is applied to the frame members 18–20 via the cable 38, whereby to cause the support frame 10 to rotate upwardly (represented by phantom lines in FIG. 1) to the raised position (designated 10-1 in FIG. 3). However, when the winch 12 turns in an opposite direction, the pulling tension on the cable 38 will be relaxed, whereby to allow the support frame 10 to rotate downwardly to the collapsed position of FIG. 2. Because the U-shaped frame members 18–20 are linked together by means of the tubular coupling bars 28 and 30, the frame members 18–20 will rotate in unison in the upward and downward directions around their hinge pins 22–24.

The batting cage 1 also includes a U-shaped pull-up rail 44 that is located adjacent a back end railing 60 that lies opposite the front end railing 50. The U-shaped pull-up rail 44 is adapted to slide vertically relative to back end railing 60 as the support frame 10 is rotated between the collapsed and raised positions for the purpose of raising and lowering the netting 16 around the batting cage 1. The legs of U-shaped pull-up rail 44 are slidably received by a pair of hollow guides 46 and 47 that are affixed to each side of the back end railing 60 (best shown in FIGS. 1 and 3).

Figure 5:
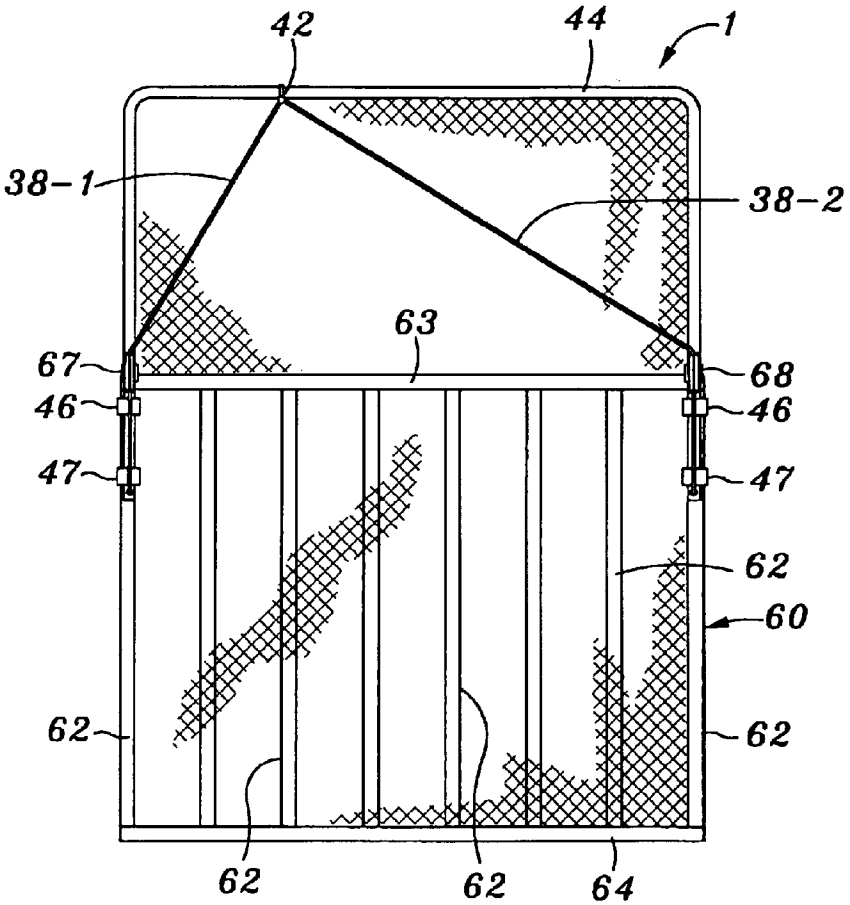
FIG. 5 shows a back end railing taken along lines 5—5 of FIG. 3.

The back end railing 60 to which the U-shaped pull-up rail 44 is coupled (by means of the pairs of guides 46 and 47 and along which the pull-up rail 44 is vertically slidable) is best shown in FIGS. 2 and 5 of the drawings. The back end railing 60 extends between the opposing pair of side railings 3 at the rear of batting cage 1. Like side railings 3, the back end railing 60 includes a plurality of spaced, parallel aligned rails 62 that run between upper and lower support rails 63 and 64.

As is best shown in FIG. 2, a pair of guide rollers or pulleys 67 and 68 is mounted opposite one another on the upper support rails 7 of each of the pair of side railings 3 so as to lie adjacent the U-shaped pull-up rail 44. After the cable 38 is tied to (i.e., looped over) the last U-shaped frame member 20 of support frame 10, the cable 38 is joined at a splice or junction 42 with two cable sections 38-1 and 38-2. Although the cable sections 38-1 and 38-2 are illustrated as having different lengths, the cable sections may have identical lengths, as well. A first of the cable sections 38-1 runs from the cable splice 42 to the bottom of one leg of the U-shaped pull-up rail 44 by way of a first of the pair of guide rollers 67. The second cable section 38-2 runs from the cable splice 42 to the bottom of the other leg of the U-shaped pull-up rail 44 by way of the second guide roller 68. Using a pair of cable sections 38-1 and 38-2 to be tied to opposite legs of the U-shaped pull-up rail 44 via respective guide rollers 67 and 68 enables the pull-up rail 44 to slide smoothly along the back end railing 60 as the support frame 10 rotates between the collapsed and raised positions.

The netting 16 is either tied to or folded over the U-shaped pull-up rail 44. As the winch 12 at the front end railing 50 is rotated in a direction by which to apply a pulling tension on the cable 38 and each of the cable sections 38-1 and 38-2 that are joined together at cable splice 42, the pull-up rail 44 will be pulled vertically upward (represented by the phantom lines in FIG. 1) at the same time that U-shaped frame members 18–20 of support frame 10 are rotated upwardly to the raised position so as to lift the netting above the side, front and back railings 3, 50 and 60 to thereby complete the batting cage 1. When the winch 12 is rotated in the opposite direction by which to relax the pulling tension on cables 38, 38-1 and 38-2, the pull-up rail 44 will slide vertically downward at the same time that the U-shaped frame members 18–20 rotate to the collapsed position, whereby the netting 16 will fall inside the railings 3, and 50 and 60.

The protective netting 16 of batting cage 1 is attached to the support frame 10 and pull-up rail 44 by means of suitable ties or straps 48 such that the netting 16 will simply hang down from the top of the support frame. As is best shown in FIG. 3, a plurality of ties 48 are employed at strategic locations to attach the netting 16 to the tops of the U-shaped frame members 18–20 and the pairs of coupling bars 28 and 30 which link the frame members to one another. It can now be appreciated that the netting 16 will be carried by the support frame 10 and the pull-up rail 44 so as to be pulled up and folded down as the support frame rotates between the collapsed and raised positions.

In the raised position of the pivotal support frame 10 as shown in FIG. 3, the netting will hang down from the U-shaped frame members 18–20 and the pull-up rail 44 so as to completely enclose the playing area and cover the insides of the front end, rear end, and side railings 50, 60 and 3. Thus, a pitching machine (not shown) can be located at the front of the batting cage 1 inside the front end railing 50, and a target (i.e., a home plate or other suitable marker) can be located at the rear of the batting cage 1 inside the back end railing 60 at which a batter can stand to hit practice pitches thrown by the pitching machine. Notwithstanding the foregoing example, the batting cage 1 herein described can also be used to provide a safe and confined environment within which to practice other sports such as golf, soccer, and football, to name but a few.

I claim:

1. A collapsible sports enclosure within which a ball can be hit, kicked or thrown without subjecting onlookers to possible injury, said collapsible enclosure comprising:

a support base having at least first and second sides that are spaced from one another;

a support frame having a plurality of U-shaped frame members that are pivotally coupled to the first and second sides of said support base so as to be rotated relative to said support base from a collapsed position lying in generally horizontal end-to-end alignment with one another between the first and second sides of said support base when the sports enclosure is not in use to a raised position lying in generally vertical spaced alignment with one another and projecting upwardly from said first and second sides when the sports enclosure is in use;

a protective netting attached to and carried by the plurality of frame members of said support frame to be lifted above the first and second sides of said support base when said frame members are rotated to the raised position and folded between the first and second sides when said frame members are rotated to the collapsed position; and a cable tied to the plurality of U-shaped frame members of said support frame, said cable adapted to receive a pulling force, whereby to cause said U-shaped frame members to rotate from said collapsed position, whereby said netting is lifted above the first and second sides of said support base.

2. The collapsible sports enclosure recited in claim 1, further comprising at least one coupling bar extending between successive ones of said plurality of U-shaped frame members for causing said plurality of frame members to be rotated in unison between said collapsed and raised positions.

3. The collapsible sports enclosure recited in claim 1, further comprising a pull-up rail adapted to move vertically upward and downward relative to the first and second sides of said support base, said netting attached to said pull-up rail such that said netting is lifted by said pull-up rail above said first and second sides at the same time that the plurality of U-shaped framed members of said support frame are rotated to the raised position, and said netting being folded by said pull-up rail between said first and second sides at the same time that said plurality of U-shaped frame members are rotated to said collapsed position.

4. The collapsible sports enclosure recited in claim 3, further comprising a cable tied to the plurality of U-shaped frame members of said support frame and to said pull-up rail, said cable receiving a pulling force whereby to cause said U-shaped frame members to rotate from the collapsed position to said raised position, said pull-up rail to move vertically upward, and said netting to be lifted above the first and second sides of said support base.

5. The collapsible sports enclosure recited in claim 4, further comprising a winch mounted on said support base and connected to said cable, said winch generating said pulling force to be applied to said cable to cause said U-shaped frame members to rotate to said raised position, said pull-up rail to move vertically upward, and said netting to be lifted above the first and second sides of said support base.

6. The collapsible sports enclosure recited in claim 5, wherein said support base also includes a front end and a back end, each of said front and back ends extending between said first and second sides, said winch mounted on said support base at the front end thereof, said pull-up rail coupled to said support base at the back end thereof, and said cable running between the front and back ends of said support base to be attached to said support frame and said pull-up rail.

* * * * *